US011971050B2

(12) United States Patent
Kilchyk et al.

(10) Patent No.: US 11,971,050 B2
(45) Date of Patent: Apr. 30, 2024

(54) VARIABLE GEOMETRY SHROUDED COMPRESSOR/BLOWER ROTOR DESIGN

(71) Applicant: Hamilton Sundstrand Corporation, Charlotte, NC (US)

(72) Inventors: Viktor Kilchyk, Lancaster, NY (US); Dmytro M. Voytovych, Rocky Hil, CT (US); Jeremy Clavette, Tolland, CT (US)

(73) Assignee: Hamilton Sundstrand Corporation, Charlotte, NC (US)

( * ) Notice: Subject to any disclaimer, the term of this patent is extended or adjusted under 35 U.S.C. 154(b) by 0 days.

(21) Appl. No.: 17/847,429

(22) Filed: Jun. 23, 2022

(65) Prior Publication Data

US 2023/0417256 A1 Dec. 28, 2023

(51) Int. Cl.

| | |
|---|---|
| ***F04D 29/46*** | (2006.01) |
| ***F04D 17/08*** | (2006.01) |
| ***F04D 27/00*** | (2006.01) |
| ***F04D 27/02*** | (2006.01) |
| ***F04D 29/28*** | (2006.01) |
| ***F04D 29/30*** | (2006.01) |
| ***F04D 29/44*** | (2006.01) |

(52) U.S. Cl.
CPC ..... *F04D 29/462* (2013.01); *F04D 17/08* (2013.01); *F04D 29/30* (2013.01); *F04D 29/442* (2013.01)

(58) Field of Classification Search
CPC ..... F04D 29/162; F04D 29/4206; F04D 27/0246; F04D 29/462; F04D 29/622; F04D 15/0038; F04D 29/284; F04D 29/30; F04D 29/624; F04D 17/025; F04D 17/10; F04D 29/023; F04D 29/46; F04D 27/002; F04D 29/042; F04D 29/2222; F04D 29/442; F04D 17/08; F01D 11/22; F01D 11/08; F01D 5/225; F01D 5/04; F01D 11/16; F01D 11/20; F01D 17/143; F05D 2220/32; F05D 2240/11; F05D 2270/62; F05D 2260/57; F05B 2220/302
See application file for complete search history.

(56) References Cited

U.S. PATENT DOCUMENTS 4,752,183 A * 6/1988 Sakurai ..... F04D 15/0038 415/12
4,828,454 A 5/1989 Morris et al.
(Continued)

FOREIGN PATENT DOCUMENTS

DE 4220962 A1 1/1994

OTHER PUBLICATIONS

Extended European Search Report for EP Application No. 23181123.3, dated Nov. 16, 2023, 6 pages.

*Primary Examiner* — Eric J Zamora Alvarez
(74) *Attorney, Agent, or Firm* — Kinney & Lange, P.A.

(57) ABSTRACT

A shrouded impeller includes an impeller having a plurality of blades and configured to rotate about an axis, and a shroud disposed adjacent to the impeller and configured to corotate about the axis with the impeller and translate axially relative to the impeller. A method of varying a geometry of a flow area of the shrouded impeller includes rotating the shroud and the impeller about the axis and axially translating the shroud relative to the impeller to increase or decrease a rate of flow between the shroud and the impeller.

16 Claims, 5 Drawing Sheets

(56) References Cited

U.S. PATENT DOCUMENTS

| | | | | |
|---|---|---|---|---|
| 5,169,286 | A * | 12/1992 | Yamada | F04D 15/0038 415/48 |
| 6,074,167 | A * | 6/2000 | Olifirov | F01D 17/143 415/157 |
| 6,669,439 | B2 * | 12/2003 | Kardasz | F04D 15/0038 415/131 |
| 10,113,556 | B2 | 10/2018 | Moniz et al. | |
| 10,465,705 | B2 | 11/2019 | Schuldt et al. | |
| 11,105,338 | B2 | 8/2021 | Nesteroff et al. | |
| 2002/0192072 | A1 | 12/2002 | Kardasz et al. | |
| 2017/0343002 | A1 | 11/2017 | Ottow et al. | |

* cited by examiner

VARIABLE GEOMETRY SHROUDED COMPRESSOR/BLOWER ROTOR DESIGN

BACKGROUND

The present application is directed generally to turbomachinery rotors and more particularly to shrouded impellers for centrifugal compressors and blowers.

Turbomachinery can be required to operate at wide operational ranges with respect to fluid flow rates. Flow rate has been controlled with a variable geometry diffuser, which can adjust a fluid flow rate by altering a diffuser width, or a fixed or variable area casing bypass (e.g., a bleed port), which removes a portion of the fluid flow. Flow rate can also be controlled by adjusting a machine rotational velocity (RPM) or a position of inlet guide vanes to throttle fluid flow to the rotor, however this also changes a pressure ratio or head. It is advantageous to be able to independently control the pressure ratio or head and flow rate of turbomachinery to meet changing operational demands while minimizing power consumption. A need exists for an impeller with a truly variable geometry that can efficiently adjust a flow rate of the turbomachinery independent of head.

SUMMARY

In one aspect, a shrouded impeller includes an impeller having a plurality of blades and configured to rotate about an axis, and a shroud disposed adjacent to the impeller and configured to corotate about the axis with the impeller and translate axially relative to the impeller.

In another aspect, a method of varying a geometry of a flow area of a shrouded impeller includes rotating an impeller and a shroud disposed adjacent to the impeller about an axis and axially translating the shroud relative to the impeller to increase or decrease a rate of flow between the shroud and the impeller.

The present summary is provided only by way of example, and not limitation. Other aspects of the present disclosure will be appreciated in view of the entirety of the present disclosure, including the entire text, claims and accompanying figures.

Figure 1:
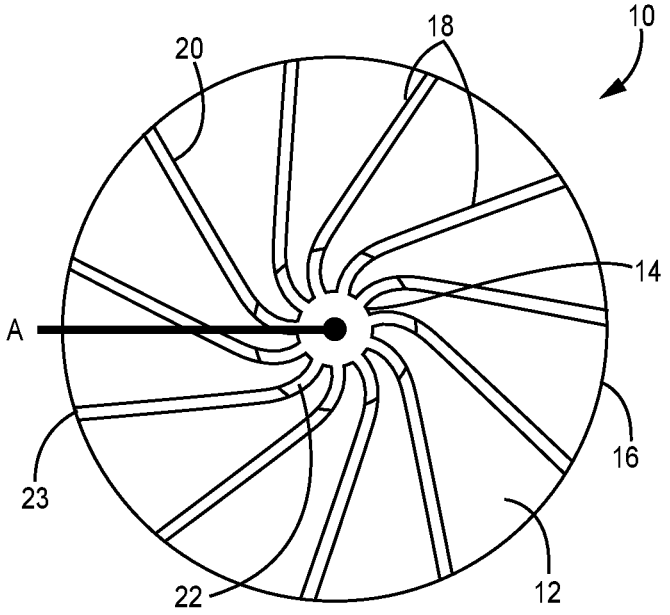
FIG. 1 PRIOR ART
FIG. 1 is a perspective view of an impeller of the prior art.

While the above-identified figures set forth embodiments of the present invention, other embodiments are also contemplated, as noted in the discussion. In all cases, this disclosure presents the invention by way of representation and not limitation. It should be understood that numerous other modifications and embodiments can be devised by those skilled in the art, which fall within the scope and spirit of the principles of the invention. The figures may not be drawn to scale, and applications and embodiments of the present invention may include features, steps and/or components not specifically shown in the drawings.

DETAILED DESCRIPTION

The present disclosure provides multiple embodiments of variable geometry shrouded impellers, which can be used to separately and independently control a flow rate and a pressure ratio or head of a centrifugal compressor or blower by varying a height at an impeller outlet. The disclosed variable geometry shrouded impellers can effectively reduce the size of a centrifugal compressor or blower having a radial flow by shrinking a flow capacity during operation, while maintaining the same head, which can be controlled by the rotational speed of the impeller and blade geometry or inlet angle. The fluid flow rate and developed head can be controlled by axially translating the shroud to reduce a height of the impeller blades and thereby a height at the impeller outlet. The disclosed variable geometry shrouded impellers can be used with variable or fixed speed machines and do not require bleed ports, variable geometry diffusers, changes in rotational speed, or throttling of flow with guide vanes to adjust the fluid flow rate. Although, discussion focuses on use of the disclosed variable geometry shrouded impeller in a centrifugal compressor or blower, it will be understood that embodiments disclosed herein can be adapted for a variety of rotor applications including radial turbines and pumps.

FIG. 1 is a perspective view of a conventional impeller 10 known in the art for use, for example, in a centrifugal compressor or blower. FIG. 1 shows impeller 10, hub 12 having shaft portion 14 and disk portion 16, blades 18 having tips 20 and leading edges 22, and axis of rotation A. Blades 18 are two-dimensional or fully axially-extending such that blades 18 extend outward from hub 12 parallel to axis A. Leading edges 22 have a circular arc geometry but are fully axially extending. Impeller 10 is provided as merely an example of a type of impeller for which a shroud can be adapted to provide a variable flow capacity. The disclosed variable geometry shrouded impellers are not limited to the particular impeller design illustrated in FIG. 1. It will be appreciated by one of ordinary skill in the art that the spacing, geometry, and number of blades 18 can be varied to ensure optimal aerodynamics as known in the art. As discussed further herein, in some embodiments, impeller blades can have a three-dimensional geometry.

Figure 2:
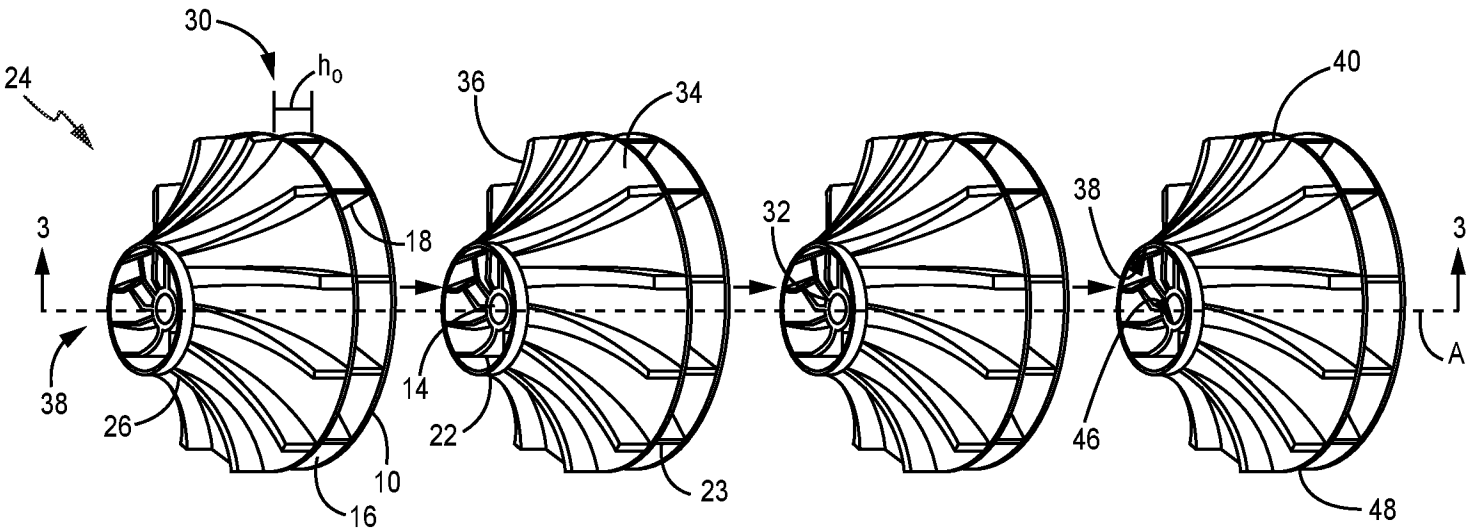
FIG. 2 shows perspective views of one embodiment of a variable geometry shrouded impeller with a shroud in varying positions.
Figure 3:
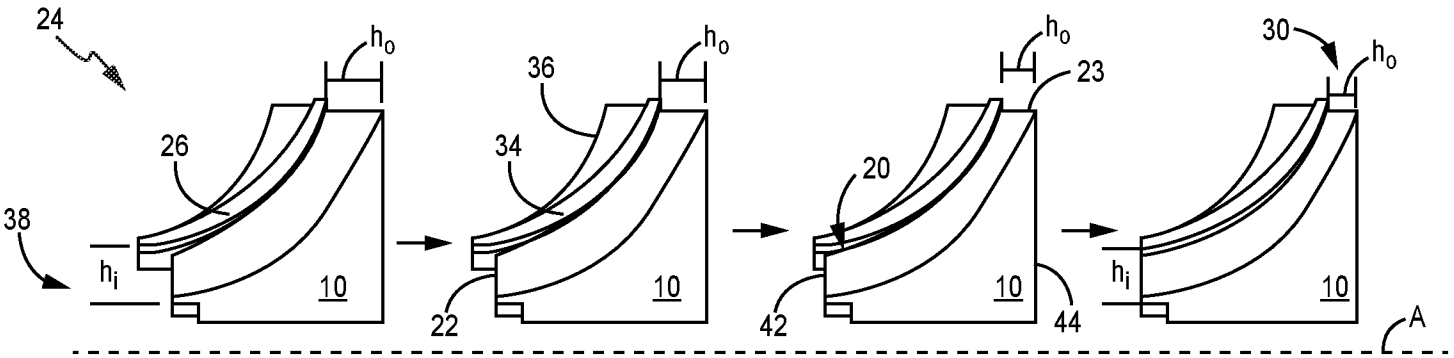
FIG. 3 shows cross-sectional views of a portion of the variable geometry shrouded impeller taken along the 3-3 line of FIG. 2.

FIG. 2 shows perspective views of one embodiment of a variable geometry shrouded impeller with a shroud in varying positions. FIG. 3 shows cross-sectional views of a portion of the variable geometry shrouded impeller 24 taken along the 3-3 line of FIG. 2. FIGS. 2 and 3 are discussed together. FIGS. 2 and 3 show variable geometry shrouded impeller 24 having impeller 10 of FIG. 1, shroud 26, fluid inlet 28, and fluid outlet 30, positioned on axis A. Impeller 10 includes hub 12 with shaft portion 14 and disk portion 16, bore 32, and blades 18 with leading edges 22, tips 20, and trailing edges 23. Shroud 26 includes wall portion 34 with hollow elements 36, inlet opening 38, and outlet edge 40. FIGS. 2 and 3 show shroud 26 being translated axially to receive a portion of impeller 10 and thereby reduce a height ho at outlet 30 to control a fluid flow capacity and fluid flow rate through variable geometry shrouded impeller 24. A height hi at inlet 28 can remain constant with axial translation of shroud 26. Variable geometry shrouded impeller 24 can be adapted for use in any shrouded impeller application for which a variable geometry is advantageous, including radial compressors, blowers, turbines, and pumps.

Impeller 10 is configured to rotate on axis A (e.g., via a rotor shaft as known in the art) with an axial inlet and radial outlet fluid flow. Impeller 10 includes two-dimensional (fully axially-extending) blades 18 that extend outward from hub 12. Bore 32 extends through a center of hub 12 including a center of shaft portion 14 and disk portion 16. Bore 32 is configured to receive, for example, a tie rod of a turbomachine. Disk portion 16 extends radially outward from shaft portion 14. Hub 12 has inlet side 42 and outlet side 44 opposite inlet side 42. Inlet side 42 is configured to be positioned at a fluid inlet location of a turbomachine. Outlet side 44 is defined by disk portion 16. Hub 12 has radially inner end 46 defined by bore 32 and radially outer end 48 defined by an outer diameter of disk portion 16. Blades 18 extend from leading edge 22 adjacent to inlet side 42 to trailing edge 23 adjacent to radially outer end 48. Blade tips 20 extend from leading edge 22 to trailing edge 23 and can generally follow a curvature of an outer surface (opposite radially inner end 46) of hub 12.

In some embodiments, blade leading edges 22 can be angled with respect to axis A to provide an optimal inlet angle to improve rotor efficiency as known in the art. For example, in some embodiments, leading edges 22 can be angled up to 40 degrees with respect to axis A such that portions of blades 18 along leading edges 22 are not fully axially extending. In some embodiments, variable geometry shrouded impeller 24 can be used in combination with a variable or fixed inlet guide vane (shown in FIG. 5) positioned axially forward (upstream) of inlet 28 to control fluid dynamics and/or head.

Shroud 26 is disposed adjacent to impeller 10 and is configured to corotate on axis A with impeller 10 and to translate axially relative to impeller 10 to increase or decrease height ho at outlet 30 to adjust a fluid flow capacity and fluid flow rate through variable geometry shrouded impeller 24. Inlet opening 38 is configured to be positioned at the fluid inlet location of a turbomachine adjacent to inlet side 42 of impeller 10. Outlet edge 40 is configured to be positioned at variable axial locations adjacent to hub 12 at outlet side 44 and outlet end 48. Shroud 26 includes wall portion 34, which extends from inlet opening 38 to oppositely positioned outlet edge 40. Wall portion 34 can have a curvature generally following a curvature of the outer surface of hub 12. Wall portion 34 can be designed to accommodate blades 18 that have leading edges 22 that are not fully axially extending but, instead, angled with respect to axis A such that shroud 26 can be axially translated without interference from portions of blades 18 that cannot be received in hollow elements 36 as described below. An inner surface of wall portion 34 and the outer surface of impeller hub 12 define a fluid flow path.

Hollow elements 36 can extend radially outward from wall portion 34 (opposite the inner surface) from a position adjacent to inlet opening 38 to outlet edge 40. Hollow elements 36 can have a shape generally matching a shape of portions of blades 18. Hollow elements 36 open to the inner surface of wall portion 34. Hollow elements 36 are closed at outlet edge 40. Internal surfaces of hollow elements 36 can define a shape generally matching the two-dimensional (fully axially-extending) shape of portions of blades 18 aft of leading edges 22, and are sized to accommodate portions of blades 18, including blade tips 20 and portions of trailing edges 23. The openings defined by the internal surfaces of hollow elements 36 can be sized to minimize a gap between an outer surface of blades 18 and shroud 26. It will be appreciated by one of ordinary skill in the art that blades 18 can be designed with varying configurations as known in the art to provide optimal performance and that the shape defined by the internal surfaces of hollow elements 36 can be designed to match a shape of portions of blades 18 that are received in shroud 26. The opening defined by the internal surfaces of hollow elements 36 can have a depth that increases from inlet opening 38 to outlet edge 40 to accommodate blades 18. In some embodiments, hollow elements 36 can extend fully to shroud inlet opening 38. In some embodiments, hollow elements 36 can be axially offset from shroud inlet opening 38 to accommodate portions of blades 18 that are not fully axially extending, e.g., due to curvature of leading edges 22.

Blades 18 can be slidably received in hollow elements 36 with actuation of shroud 26 (i.e., axial translation toward impeller 10). In some embodiments, some contact can occur between blades 18 and internal surfaces of hollow elements 36 with axial translation of shroud 26. Blades 18 can be sized to provide minimum leakage at blade tips 22. In some embodiments, hollow elements 36 can be sized to minimally contact or rub outer surfaces of blades 18 with axial translation of shroud 26. Hollow elements 36 can be sized such that the force of shroud 26 with actuation overcomes friction, allowing blades 18 to be received in hollow elements 36. Hollow elements 36 can be sized to limit wear on blades 18 and/or internal surfaces of hollow elements 36 over time.

Inlet opening 38 can circumscribe or extend around a radially outer limit of leading edges 22 of impeller blades 18, such that upon axial translation of shroud 26 there is no contact between shroud 26 and blade leading edges 22. Inlet opening 38 can be defined by a solid ring without hollow elements 36. As previously noted, in some embodiments, hollow elements 36 can extend fully to inlet opening 38. The inlet height A is the distance between an inner surface of wall portion 34 and an outer surface of impeller shaft portion 14 at inlet 28.

Outlet edge 40 is configured to be positioned at variable axial locations adjacent to hub 12 at outlet side 44 and outlet end 48. As illustrated, height ho is the distance between axial-facing surfaces adjacent to outlet edge 40 and outlet end 48 at outlet 30. Hollow elements 36 can extend to outlet edge 40, forming a portion of outlet edge 40. Hollow elements 36 are closed at a radially outer extent to cover a portion of trailing edges 23 when received in hollow elements 36.

Shroud 26 corotates with impeller 10 such that blades 18 are aligned with hollow elements 36 and can be received in hollow elements 36. Shroud 26 can be translated axially toward impeller 10. Impeller 10 maintains a constant axial position. In a fully open position (maximum ho), shroud inlet opening 38 can be positioned axially forward of impeller inlet side 42. In a fully reduced position (minimum ho), shroud inlet opening 38 can be substantially axially aligned with impeller inlet side 42. As illustrated in FIG. 3, inlet height hi remains substantially constant as shroud 26 is translated axially, while outlet height ho is reduced. In some embodiments, outlet height ho can be reduced by up to one-third or up to one-half from the fully open position to the fully reduced position. Shroud inlet opening 38 can be radially spaced from a radially outermost extent of blade leading edges 22.

As illustrated, in a fully open position (maximum ho), an inner surface of shroud wall portion 34 can be spaced from blade tips 22 adjacent inlet 28 and axially aligned with or axially overlapping blade tips 22 adjacent outlet 30. In a fully open position (maximum ho), blade tips 22 adjacent to trailing edges 23 can be received in shroud hollow elements 36. In a fully reduced position (minimum ho), a majority of the extent of blade tips 22 (from leading edge 22 to trailing edge 23) can be received in shroud hollow elements 36. In some embodiments, the full extent of blade tips 20 can be received in shroud hollow elements 36 in the fully reduced position. The extent to which blades 18 are received in hollow elements 36 can vary depending on the design of blades 18 and hub 12. In all embodiments, shroud 26 is designed to be able to corotate with impeller 10 while translating axially to receive blades 18 in hollow elements 36 and effectively increase or decrease a flow capacity and outlet height ho.

Shroud 26 can be translated axially along axis A prior to or during operation (i.e., during rotation of impeller 10) to accommodate changes in operational needs (e.g., air supply demand). For example, cabin air compressors used to compress air for use in an environmental control system of an aircraft may have varying operational demands depending on the number of passengers in the aircraft. A flight having a small number of passengers may require a lower air exchange than a flight at full capacity. Variable geometry shrouded impeller 24 allows for the control of the fluid flow rate through axial translation of shroud 26 to increase or decrease height ho at outlet 30, as needed for optimal operation. Variable geometry shrouded impeller 24 can be used to effectively increase or decrease the size of a compressor independent of head or pressure ratio, which could be maintained at a constant value. Impeller 10 can be a single speed or variable speed impeller. Variable geometry shrouded impeller 24 can change the flow rate for a single speed impeller, while maintain a constant rotor speed and head and varying the power consumed. The power consumed is reduced by reducing the flow rate while maintaining a constant rotor speed.

Varying actuation and support mechanisms can be used to move shroud 26 and can be designed to accommodate particular turbomachine assemblies. Shroud 26 can be fixed to a turbomachine rotor shaft to provide for corotation with impeller 10. Shroud 26 can be configured to be translated axially through operation of an actuator (shown in FIG. 4). Various bearing assemblies and seal assemblies can be used rotatably fix shroud 26 to static structures of the turbomachine and contain a fluid flow. In some embodiments, outlet edge 40 can be extended to form a portion of a diffuser wall or can be otherwise designed to interface with a diffuser section. Variable geometry shrouded impeller 24 can be positioned downstream of a variable or fixed inlet guide vane to control fluid dynamics and/or head. Use of an inlet guide vane may be particularly beneficial for impellers with two-dimensional (fully axially-extending) blades to optimize efficiency.

Figure 4:
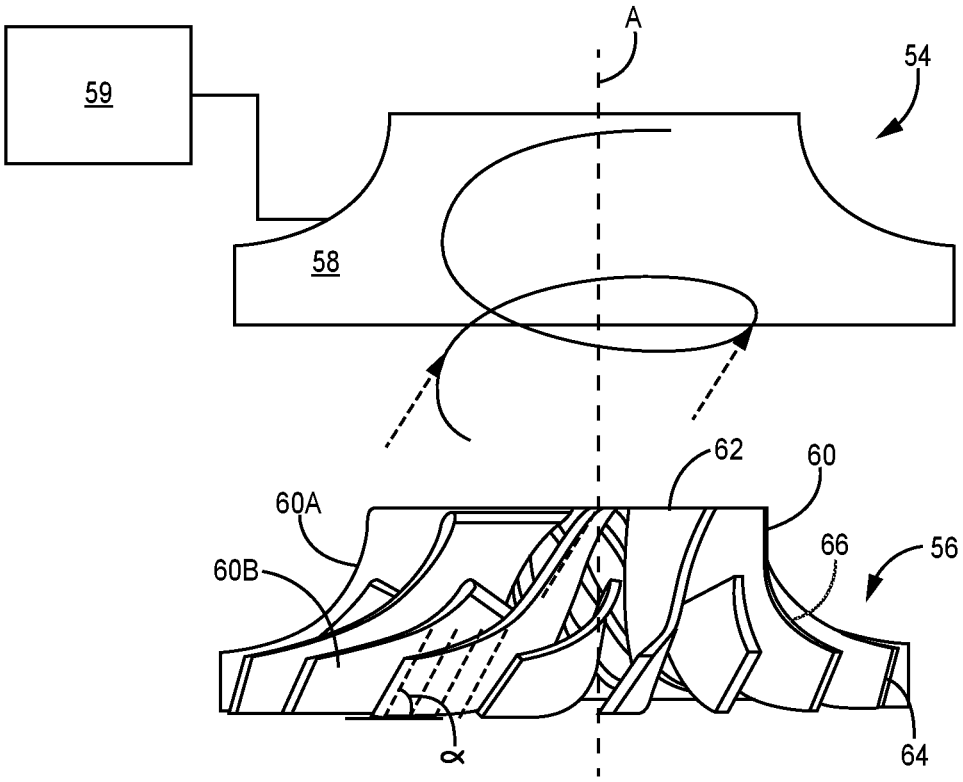
FIG. 4 is a schematized view of another embodiment of a variable geometry shrouded impeller.

FIG. 4 is a schematized view of another embodiment of a variable geometry shrouded impeller. FIG. 4 shows variable geometry shrouded impeller 54 having impeller 56 and shroud 58, and actuator 59 configured to translate shroud 58 axially. Variable geometry shrouded impeller 54 is substantially similar to variable geometry shrouded impeller 26 of FIGS. 2 and 3 with the exception that impeller 56 includes three-dimensional (i.e., not fully axially extending) blades 60 (including long blades 60A and short, splitter, blades 60B). Variable geometry shrouded impeller 54 operates in substantially the same manner as variable geometry shrouded impeller 26 of FIGS. 2 and 3 with the exception that shroud 58 can be actuated circumferentially relative to impeller 56 with axial translation to twist on or off impeller blades 60 (i.e., spiral motion). In other words, actuation of shroud 58 includes both an axial component and a circumferential component while shroud 58 continues to rotate with impeller 56.

Blades 60 extend from a hub (not shown) as described with respect to FIGS. 1-3. Leading edges 62, trailing edges 64, and blade tips 66 are shown. Blades 60 extend from the hub at angle $\alpha$ relative to the axis, such that each location of each blade is displaced by angle $\alpha$ from a position of a fully axially-extending blade (e.g., blade 18 in FIGS. 1-3). In other words, blades 60 are oriented at an angle that is constant with respect to axis A. The angling of one blade 60A is shown with dashed lines. The constant angle of blades 60 allows blades 60 to be received in hollow elements of shroud 58 as described with respect to FIGS. 2 and 3 but requires the additional twisting motion or independent rotation of shroud 58 relative to impeller 54 to move blades 60 in and out of the shroud hollow elements. In some embodiments, leading edges 62 can be further angled with respect to axis A as described with respect to variable geometry shrouded impeller 26 to provide an optimal inlet angle. In such embodiments, shroud 58 can be designed with hollow elements beginning aft of the complex shaped portions of blades 60 near leading edges 62 to allow shroud 58 to translate axially without interference from blades 60.

Shroud 58 is shown schematically. Shroud 58 can be substantially similar to shroud 26 of variable geometry shrouded impeller 56 with the exception that hollow elements of shroud 58 are angled with respect to axis A in a manner consistent with blades 60 such that blades 60 can be received in hollow elements of shroud 58 with axial translation and rotation independent of impeller 56. Hollow elements of shroud 58 can be designed to receive blades 60A and 60B. As such, hollow elements accommodating blades 60A can have a different geometry than hollow elements accommodating blades 60B and, furthermore, may extend different lengths between a shroud inlet opening and shroud outlet edge to accommodate long blades 60A and short, splitter, blades 60B.

Variable geometry shrouded impeller 54 can be adapted for use in any shrouded impeller application for which a variable geometry is advantageous, including radial compressors, blowers, turbines, and pumps.

Experimental Results

Numerical analysis of a 2.5 pressure ratio compressor with a mass flow rate of 0.6 kg/s and rotational speed of 40K rpm was conducted for variable geometry shrouded impellers embodiments having a) two-dimensional (fully axially-extending) blades and b) three-dimensional blades oriented at a constant 33 degree angle relative to an axis of rotation. Up to 90.7% rotor efficiency was achieved with two-dimensional blades. Up to 94.4% rotor efficiency was achieved with the three-dimensional blades. It is expected that with CFD screening and/or combined use with an inlet guide vane, a rotor efficiency of greater than 96% will be possible. Use of an inlet guide vane can improve rotor efficiency when blade inlet angle is not optimum (e.g., less than 60 degrees relative to the axis of rotation). Use of an inlet guide vane may provide particular benefit in improving rotor efficiency for variable geometry shrouded impellers having two-dimensional blades.

Figure 5:
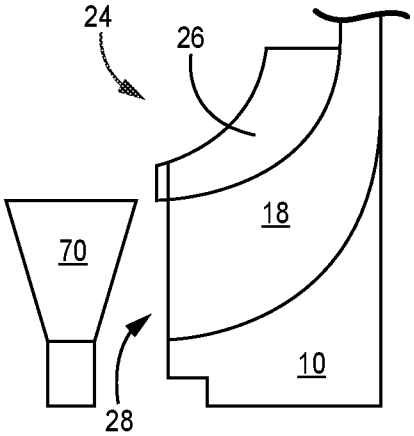
FIG. 5 is a schematized view of the variable geometry shrouded rotor of FIGS. 2 and 3 with an inlet guide vane.

FIG. 5 shows a schematized view of variable geometry shrouded rotor 26 with inlet guide vane 70 positioned axially forward of inlet 28 to control an inlet angle. Inlet guide vane 70 can be a fixed or variable guide vane as known in the art. Inlet guide vane 70 can be adapted for use, for example, with variable geometry shrouded rotor 24 to define a fluid flow path at inlet 28. Axial translation of shroud 26 toward rotor 10 changes the flow rate, which can impact the inlet flow angle as the inlet blade height does not change the same way as the exit flow path. As illustrated in FIG. 2B, shroud 26 can be positioned at any axial location to achieve a desired flow rate. The inlet flow angle at each axial potion of shroud 26 can be determined and inlet guide vanes 70 having variable geometry can be used to compensate for any change in the inlet flow angle at each axial position of shroud 26.

Figure 6A:
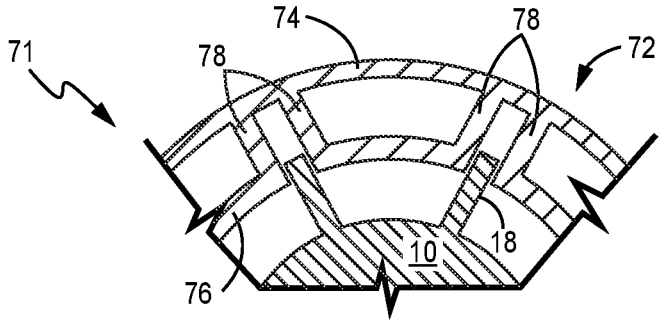
FIGS. 6A and 6B are cross-sectional views of other embodiments of a shroud of a variable geometry shrouded impeller.
Figure 6B:
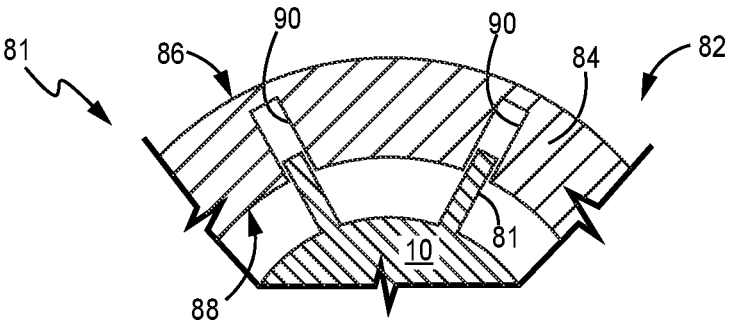

FIGS. 6A and 6B are cross-sectional views of alternative embodiments of a variable geometry shrouded impeller. FIG. 6A shows variably geometry shrouded impeller 71 with impeller 10 and shroud 72 having outer wall 74, inner wall 76, and ribs 78. FIG. 6B shows variable geometry shrouded impeller 81 with impeller 10 and shroud 82 having solid wall 84 with outer surface 86, inner surface 88, and slots 90. FIGS. 6A and 6B are discussed together. Shrouds 72 and 82 are substantially similar to shroud 26 of FIGS. 2 and 3 and shroud 58 of FIG. 4 with the exception that shrouds 72 and 82 have a substantially smooth outer surface (outer surface of outer wall 74 and outer surface 86, respectively) and thick axial dimension. A profile of shrouds 72 and 82 at outer surface of wall 74 and at outer surface 86, respectively, can be substantially similar to a profile of impeller blade tips. Shroud 72 is substantially hollow to reduce weight. Shroud 82 is solid. Weight reduction of shroud 82 can be achieved through material selection. Shrouds 72 and 82 can be adapted for use with a variety of impellers having two- or three-dimensional blades (e.g., impeller 10, as shown, and impeller 56). Shrouds 72 and 82 can be adapted for use in any variable geometry shrouded impeller application including radial compressors, blowers, turbines, and pumps.

As illustrated in FIG. 6A, shroud 72 includes outer wall 74 and inner wall 76, which are spaced apart. Ribs 78 extend between and connect outer and inner walls 74 and 76. Ribs 78 are circumferentially spaced to create voids between outer wall 74 and inner wall 76. Ribs 78 define hollow elements (similar to hollow elements 36 of shroud 26) to receive impeller blades 18. Inner wall 76 is open between pairs of ribs corresponding to locations of impeller blade locations. Spacing between pairs of ribs 78 and orientation of ribs 78 corresponding to impeller blade locations can be substantially similar to a blade thickness and blade profile to minimize fluid loses while allowing shroud 72 to receive and release impeller blades 18 upon actuation of shroud 72. Ribs 78 can be designed with a thickness and arrangement to provide structural stability to shroud 72 during operation while minimizing a weight of shroud 72. In some embodiments, and interior of shroud 76 can have an additional lattice structure or other arrangements of rigid elements or ribs to increase a structural stability of shroud 72.

As illustrated in FIG. 6B, shroud 82 includes wall 84, which is a solid wall having outer surface 86 and inner surface 88. Slots 90 open to inner surface 88 and extend through a partial thickness of wall 84. Slots 90 define hollow elements (similar to hollow elements 36 of shroud 26) to receive impeller blades 18. The locations of slots 90 corresponds to impeller blade locations. A size and cross-sectional profile of slots 90 can be substantially similar to a blade thickness and blade profile to minimize fluid loses while allowing shroud 82 to receive and release impeller blades 18 upon actuation of shroud 82.

The disclosed variable geometry shrouded impellers can be used to effectively adjust the size of compressors and blowers by separately controlling a flow rate and pressure ratio or head and changing a flow capacity by varying a height at an impeller outlet. The disclosed variable geometry shrouded impellers can be used with variable or fixed speed machines and do not require bleed ports, variable geometry diffusers, changes in rotational speed, or throttling of flow with guide vanes to adjust the fluid flow rate. It will be appreciated by one of ordinary skill in the art that the disclosed variable shrouded impellers can be adapted for a wide variety of applications that use centrifugal or radial compressors, blowers, turbines, and pumps.

Any relative terms or terms of degree used herein, such as "substantially", "essentially", "generally", "approximately" and the like, should be interpreted in accordance with and subject to any applicable definitions or limits expressly stated herein. In all instances, any relative terms or terms of degree used herein should be interpreted to broadly encompass any relevant disclosed embodiments as well as such ranges or variations as would be understood by a person of ordinary skill in the art in view of the entirety of the present disclosure, such as to encompass ordinary manufacturing tolerance variations, incidental alignment variations, transient alignment or shape variations induced by thermal, rotational or vibrational operational conditions, and the like. Moreover, any relative terms or terms of degree used herein should be interpreted to encompass a range that expressly includes the designated quality, characteristic, parameter or value, without variation, as if no qualifying relative term or term of degree were utilized in the given disclosure or recitation.

Discussion of Possible Embodiments

The following are non-exclusive descriptions of possible embodiments of the present invention.

A shrouded impeller includes an impeller having a plurality of blades and configured to rotate about an axis, and a shroud disposed adjacent to the impeller and configured to corotate about the axis with the impeller and translate axially relative to the impeller.

The shrouded impeller of the preceding paragraph can optionally include, additionally and/or alternatively, any one or more of the following features, configurations and/or additional components:

The shrouded impeller of any of the preceding paragraphs, wherein the shroud includes s a plurality of hollow elements configured to receive portions of the plurality of blades of the impeller with axial translation of the shroud relative to the impeller.

The shrouded impeller of any of the preceding paragraphs, wherein tips of the plurality of blades are received in the hollow elements.

The shrouded impeller of any of the preceding paragraphs, wherein an internal geometrical shape of the hollow elements substantially matches a shape of the plurality of blades.

The shrouded impeller of any of the preceding paragraphs, wherein blades of the plurality of blades extend parallel to the axis.

The shrouded impeller of any of the preceding paragraphs, wherein leading edges of the plurality of blades are disposed at an angle relative to the axis.

The shrouded impeller of any of the preceding paragraphs, wherein the angle is less than or equal to 40 degrees.

The shrouded impeller of any of the preceding paragraphs, wherein an inlet of the shroud circumscribes the leading edges of the plurality of blades.

The shrouded impeller of any of the preceding paragraphs, wherein blades of the plurality of blades extend at an angle relative to the axis, wherein each location of each blade is displaced by a first angle from a position of a fully axially extending blade.

The shrouded impeller of any of the preceding paragraphs, wherein the shroud is configured to be actuated circumferentially relative to the impeller with axial translation.

A method of varying a geometry of a flow area of a shrouded impeller includes rotating an impeller and a shroud disposed adjacent to the impeller about an axis and axially translating the shroud relative to the impeller to increase or decrease a rate of flow between the shroud and the impeller.

The method of the preceding paragraph can optionally include, additionally and/or alternatively, any one or more of the following features, configurations, additional components, and/or steps:

The method of any of the preceding paragraphs and further including receiving tips of blades in hollow elements of the shroud with axial translation of the shroud toward a hub of the impeller.

The method of any of the preceding paragraphs, wherein blades of the impeller extend parallel to the axis.

The method of any of the preceding paragraphs, wherein at least portions of blades of the impeller extend at an angle relative to the axis.

The method of any of the preceding paragraphs and further including actuating the shroud circumferentially relative to the impeller with axial translation.

The method of any of the preceding paragraphs and further including varying a geometry of an inlet guide vane upstream of the shrouded impeller with axial translation of the shroud, wherein varying the geometry of the inlet guide vane changes an inlet flow angle of the shrouded impeller.

While the invention has been described with reference to an exemplary embodiment(s), it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment(s) disclosed, but that the invention will include all embodiments falling within the scope of the appended claims.

The invention claimed is:

1. A shrouded impeller comprising:

an impeller comprising:

a hub having a shaft portion disposed at a radially extending inlet;

a disk portion disposed at an axially extending outlet; and a plurality of blades having leading edges disposed at the radially extending inlet, wherein the impeller is configured to rotate about an axis; and a shroud disposed adjacent to the impeller and configured to corotate about the axis with the impeller and translate axially relative to the impeller; wherein the shroud comprises a plurality of hollow elements configured to receive portions of the plurality of blades of the impeller with axial translation of the shroud relative to the impeller and wherein tips of each of the plurality of blades are received in the plurality of hollow elements, the tips extending from the leading edge to a trailing edge of each of the plurality of blades;

wherein an opening at an inlet of the shroud circumscribes the leading edges of the plurality of blades such that the opening is disposed radially outward of a radial outermost extent of leading edges of the plurality of blades; and wherein each of the plurality of hollow elements is closed at an outlet edge, the outlet edge disposed adjacent to corresponding trailing edges of the plurality of blades.

2. The shrouded impeller of claim 1, wherein an internal geometrical shape of each of the plurality of hollow elements matches a shape of the plurality of blades.

3. The shrouded impeller of claim 1, wherein blades of the plurality of blades extend parallel to the axis.

4. The shrouded impeller of claim 1, wherein leading edges of the plurality of blades are disposed at an angle relative to the axis.

5. The shrouded impeller of claim 4, wherein the angle is less than or equal to 40 degrees.

6. The shrouded impeller of claim 1, wherein blades of the plurality of blades extend at an angle relative to the axis, wherein each location of each blade is displaced by a first angle from a position of a fully axially extending blade.

7. The shrouded impeller of claim 6, wherein the shroud is configured to be actuated circumferentially relative to the impeller with axial translation.

8. The shrouded impeller of claim 1, wherein:

a distance between the shaft portion and the shroud remains constant at the inlet with axial translation of the shroud; and a distance between the disk portion and the shroud changes with axial translation of the shroud.

9. The shrouded impeller of claim 1, wherein the shroud is configured to be translated axially by an actuator.

10. A turbomachine comprising the shrouded impeller of claim 1, wherein the shroud is configured to translate axially relative to the impeller during operation of the turbomachine.

11. The turbomachine of claim 10, and further comprising a guide vane disposed upstream of an inlet of the shrouded impeller.

12. A method of varying a geometry of a flow area of a shrouded impeller, the method comprising:

rotating a shroud and an impeller about an axis, wherein the shroud is disposed adjacent to an impeller and configured to corotate about the axis with the impeller, the impeller comprising:

a hub having a shaft portion disposed at a radially extending inlet;

a disk portion disposed at an axially extending outlet; and a plurality of blades having leading edges disposed at the radially extending inlet, wherein the impeller is configured to rotate about the axis;

wherein an opening at an inlet of the shroud circumscribes the leading edges of the plurality of blades such that the opening is disposed radially outward of a radial outermost extent of blade leading edges; and axially translating the shroud relative to the impeller to increase or decrease a rate of flow between the shroud and the impeller;

wherein the shroud comprises a plurality of hollow elements configured to receive portions of the plurality of blades of the impeller with axial translation of the shroud relative to the impeller and wherein tips of each of the plurality of blades are received in the plurality of hollow elements, the tips extending from the leading edge to a trailing edge of each of the plurality of blades; and wherein each of the plurality of hollow elements is closed at an outlet edge, the outlet edge disposed adjacent to corresponding trailing edges of the plurality of blades.

13. The method of claim 12, wherein blades of the impeller extend parallel to the axis.

14. The method of claim 12, wherein at least portions of blades of the impeller extend at an angle relative to the axis.

15. The method of claim 14, and further comprising actuating the shroud circumferentially relative to the impeller with axial translation.

16. The method of claim 12, and further comprising varying a geometry of an inlet guide vane upstream of the shrouded impeller with axial translation of the shroud, wherein varying the geometry of the inlet guide vane changes an inlet flow angle of the shrouded impeller.

* * * * *